US008575507B2

(12) United States Patent
Pippin et al.

(10) Patent No.: US 8,575,507 B2
(45) Date of Patent: Nov. 5, 2013

(54) SIMPLIFIED SORT INDUCTION PROCESS AND APPARATUS

(75) Inventors: James Moody Pippin, Keller, TX (US); Uwe Neitzel, Trophy Club, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 250 days.

(21) Appl. No.: 13/102,413

(22) Filed: May 6, 2011

(65) Prior Publication Data

US 2012/0017785 A1 Jan. 26, 2012

Related U.S. Application Data

(60) Provisional application No. 61/331,851, filed on May 6, 2010.

(51) Int. Cl.
*B07C 5/00* (2006.01)

(52) U.S. Cl.
USPC ..... 209/584; 209/900; 414/390

(58) Field of Classification Search
USPC ..... 209/583, 584, 900; 700/223–227; 414/277, 278, 390, 392
See application file for complete search history.

(56) References Cited

U.S. PATENT DOCUMENTS

| | | | | |
|---|---|---|---|---|
| 3,337,066 | A | 8/1967 | Reed et al. | |
| 3,613,910 | A | 10/1971 | Weir | |
| 3,792,785 | A * | 2/1974 | Weir | 414/278 |
| 5,088,873 | A | 2/1992 | Ruder et al. | |
| 5,325,953 | A | 7/1994 | Doster et al. | |
| 5,333,340 | A | 8/1994 | Moseley | |
| 5,403,142 | A | 4/1995 | Stewart | |
| 5,411,151 | A * | 5/1995 | Sasada | 209/583 |
| 6,784,391 | B2 * | 8/2004 | Takizawa | 209/583 |
| 6,823,985 | B2 | 11/2004 | Gilmore et al. | |
| 7,177,444 | B2 * | 2/2007 | Bonner et al. | 382/101 |
| 7,235,756 | B2 * | 6/2007 | De Leo et al. | 209/584 |
| 7,653,457 | B2 | 1/2010 | Bloom | |
| 7,695,235 | B1 | 4/2010 | Rallis | |
| 7,947,916 | B2 * | 5/2011 | Stemmle | 209/584 |
| 2005/0002772 | A1 | 1/2005 | Stone | |
| 2007/0160449 | A1 | 7/2007 | Girn et al. | |
| 2008/0179225 | A1 * | 7/2008 | Bowers et al. | 209/584 |
| 2011/0058923 | A1 | 3/2011 | Campbell et al. | |

OTHER PUBLICATIONS

Jasper Van Den Driest, "A Fully Automated Solution for Parcel Loading and Unloading", ancra Loading+Unloading Solutions, Post-Expo 2009, 23 pages.
James Johnson, "Unloading Trailer", nerac, Apr. 1, 2010, 63 pages.

* cited by examiner

*Primary Examiner* — Joseph C Rodriguez

(57) ABSTRACT

A parcel processing system and method. The system includes an automated unloading apparatus, a singulation apparatus, a scan apparatus, and a sorting system. The automated unloading apparatus is configured to unload parcels from a trailer substantially without human intervention. The singulation apparatus is configured to singulate parcels unloaded by the automated unloading apparatus. The scan apparatus is configured to read from the parcels identifying information relating to the parcels. The sorting system is configured to sort the parcels according to the information read from the parcels by the scan apparatus.

17 Claims, 4 Drawing Sheets

SIMPLIFIED SORT INDUCTION PROCESS AND APPARATUS

CROSS-REFERENCE TO RELATED APPLICATIONS

The present application is related to, and claims priority to, U.S. Provisional Patent Application No. 61/331,851, filed May 6, 2010, which is hereby incorporated by reference into the present application as if fully set forth herein. The present application is also related to U.S. patent application Ser. No. 13/091,583, filed Apr. 21, 2011, and U.S. Provisional Patent Application No. 61/326,876, filed Apr. 22, 2010, both of which are hereby incorporated by reference into the present application as if fully set forth herein.

TECHNICAL FIELD

The present disclosure is directed, in general, to mail and parcel processing techniques.

BACKGROUND OF THE DISCLOSURE

Improved and more efficient systems for unloading and sorting parcels from a container or trailer are desirable.

SUMMARY OF THE DISCLOSURE

Various disclosed embodiments include a parcel processing system and method. In one embodiment, a parcel processing system includes an automated unloading apparatus, a singulation apparatus, a scan apparatus, and a sorting system. The automated unloading apparatus is configured to unload parcels from a trailer substantially without human intervention. The singulation apparatus is configured to singulate parcels unloaded by the automated unloading apparatus. The scan apparatus is configured to read from the parcels identifying information relating to the parcels. The sorting system is configured to sort the parcels according to the information read from the parcels by the scan apparatus.

In another embodiment, a parcel processing system includes a data processing system, an automated unloading apparatus, a singulation apparatus, a scan apparatus, and a sorting system. The automated unloading apparatus is configured to unload parcels from a trailer substantially without human intervention. The singulation apparatus is configured to singulate parcels unloaded by the automated unloading apparatus. The scan apparatus is configured to read from the parcels identifying information relating to the parcels and send the information to the data processing system. The sorting system is configured to sort the parcels according to information received from the data processing system.

In still another embodiment, a method of processing parcels includes unloading a trailer with an automated unloading apparatus, substantially without human intervention. The method also includes singulating parcels unloaded by the automated unloading apparatus. The method further includes scanning the parcels to read identifying information relating to the parcels. The method also includes sending the information read from the parcels to a data processing system. The method further includes sorting the parcels according to information received from the data processing system.

The foregoing has outlined rather broadly the features and technical advantages of the present disclosure so that those skilled in the art may better understand the detailed description that follows. Additional features and advantages of the disclosure will be described hereinafter that form the subject of the claims. Those skilled in the art will appreciate that they may readily use the conception and the specific embodiment disclosed as a basis for modifying or designing other structures for carrying out the same purposes of the present disclosure. Those skilled in the art will also realize that such equivalent constructions do not depart from the spirit and scope of the disclosure in its broadest form.

Before undertaking the DETAILED DESCRIPTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

Figure 1:
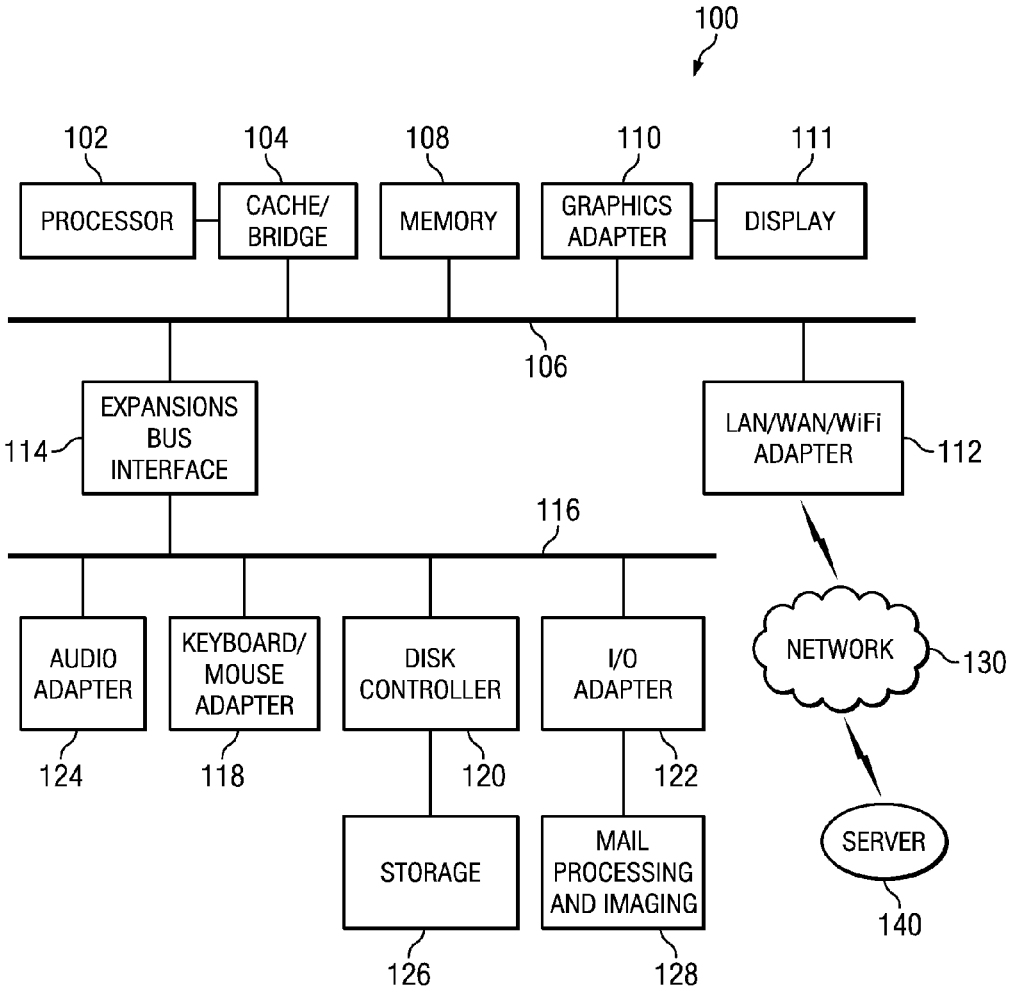
FIG. 1 depicts a block diagram of a data processing system in which an embodiment can be implemented.

FIGS. 1 through 5, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. The numerous innovative teachings of the present application will be described with reference to exemplary non-limiting embodiments.

In an effort to increase load density and reduce transportation cost, the trucking industry may use a practice called "bed-loading". A trailer may be loaded with parcels of a broad range of sizes, weights, and shapes. As used herein, the term 'trailer' refers to truck trailers, trucks, shipping containers, and other containers suitable for holding parcels during transportation. As used herein, the term "parcel" refers to an envelope, flats (e.g., cardboard envelope or wrapped magazine), parcel, package, sack, bag, box, barrel, bottle, pallet, luggage, or other item. Sacks and parcels having extreme aspect ratios or weights are typically bed-loaded last in a separate area of the trailer or box bed. On a full trailer, such extreme pieces may be located near the trailer door and would be the first parcels unloaded.

Manually unloading a bed-loaded trailer can be a hard job that may be performed at extreme temperatures with relatively low pay. A person unloading standard parcels with the aid of an extendible conveyor may achieve sustained rates in the range of 1,000 pieces per hour (1K PPH). Sacks and parcels of irregular size/shape are typically unloaded at rates much less than standard parcels. Such reduced rates are often 200-500 PPH, depending on weight, shape, door configuration, and other factors. The time required to load or unload a trailer directly affects dock door utilization/productivity and therefore facility size. Problems have arisen with previous attempts to automate trailer unloading, including solution cost, cube loss, trailer fleet modification, throughput, staffing, parcel size/type/formats, loading constraints/configuration, parcel damage, ease of operation/automation, cost to maintain and ease of retrofitting existing loading dock facilities.

Automated trailer unloaders may unload a trailer substantially without human intervention. Human intervention may be required to initially set up such automated unloaders adjacent to a stack or pile of items in the trailer, to clear a jam preventing items from being unloaded, to reposition the unloader if a gap between stacks or piles of items is encountered, or in other such anomalous circumstances, but such automated unloaders are operable to unload a trailer without human intervention in most other circumstances. Such unloaders may unload a trailer at a rate of 4,000 to 5,000 parcels per hour. As a result, an automated unloading facility with fewer unloading docks may handle a similar volume of parcels as a manual unloading facility with four or five times as many docks.

FIG. 1 depicts a block diagram of a data processing system 100 in which an embodiment can be implemented, for example as a control system for a mechanism as described below, and can be configured to perform processes as described herein. The data processing system depicted includes a processor 102 connected to a level two cache/bridge 104, which is connected in turn to a local system bus 106. Local system bus 106 may be, for example, a peripheral component interconnect (PCI) architecture bus. Also connected to local system bus in the depicted example are a main memory 108 and a graphics adapter 110. The graphics adapter 110 may be connected to display 111.

Other peripherals, such as local area network (LAN)/Wide Area Network/Wireless (e.g. WiFi) adapter 112, may also be connected to local system bus 106. Expansion bus interface 114 connects local system bus 106 to input/output (I/O) bus 116, I/O bus 116 is connected to keyboard/mouse adapter 118, disk controller 120, and adapter 122. Disk controller 120 can be connected to a storage 126, which can be any suitable machine usable or machine readable storage medium, including but not limited to nonvolatile, hard-coded type mediums such as read only memories (ROMs) or erasable, electrically programmable read only memories (EEPROMs), magnetic tape storage, and user-recordable type mediums such as floppy disks, hard disk drives and compact disk read only memories (CD-ROMs) or digital versatile disks (DVDs), and other known optical, electrical, or magnetic storage devices.

I/O adapter 122 can be connected to mail processing and imaging devices 128, as described herein, to image, scan, transport, label, address process, sort, and otherwise processes the mail pieces in accordance with the various embodiments described herein.

Also connected to I/O bus 116 in the example shown is audio adapter 124, to which speakers (not shown) may be connected for playing sounds. Keyboard/mouse adapter 118 provides a connection for a pointing device (not shown), such as a mouse, trackball, trackpointer, etc.

Those of ordinary skill in the art will appreciate that the hardware depicted in FIG. 1 may vary for particular implementations. For example, other peripheral devices, such as an optical disk drive and the like, also may be used in addition or in place of the hardware depicted. The depicted example is provided for the purpose of explanation only and is not meant to imply architectural limitations with respect to the present disclosure.

A data processing system in accordance with an embodiment of the present disclosure includes an operating system employing a graphical user interface. The operating system permits multiple display windows to be presented in the graphical user interface simultaneously, with each display window providing an interface to a different application or to a different instance of the same application. A cursor in the graphical user interface may be manipulated by a user through the pointing device. The position of the cursor may be changed and/or an event, such as clicking a mouse button, generated to actuate a desired response.

One of various commercial operating systems, such as a version of Microsoft Windows™, a product of Microsoft Corporation located in Redmond, Wash. may be employed if suitably modified. The operating system is modified or created in accordance with the present disclosure as described.

LAN/WAN/Wireless adapter 112 can be connected to a network 130 (not a part of data processing system 100), which can be any public or private data processing system network or combination of networks, as known to those of skill in the art, including the Internet. LAN/WAN/Wireless adapter 112 can also communicate with packages as described herein, and perform other data processing system or server processes described herein. Data processing system 100 can communicate over network 130 with one or more server systems 140, which are also not part of data processing system 100, but can be implemented, for example, as separate data processing systems 100. A server system 140 can be, for example, a central server system at a central mail processing facility.

Figure 2:
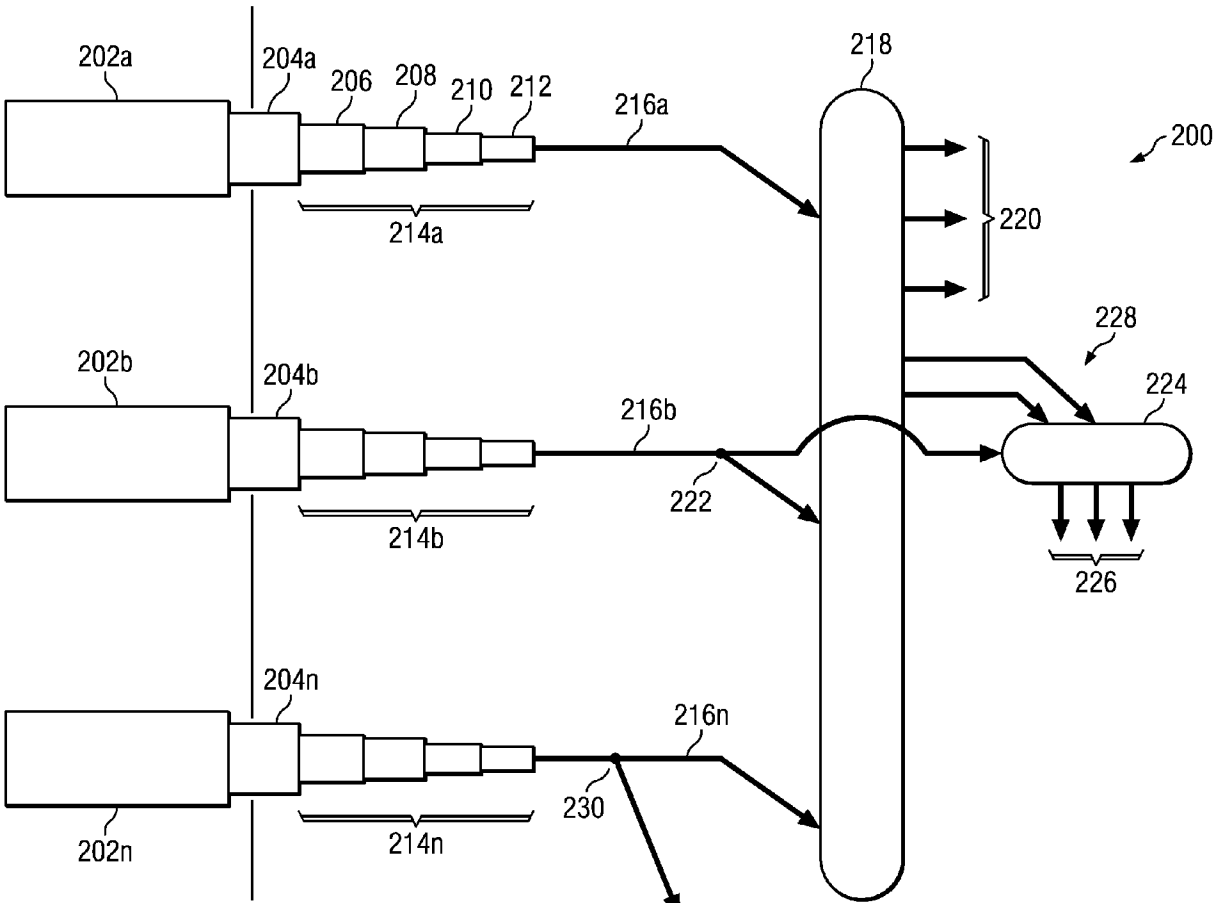
FIG. 2 depicts a schematic view of a parcel processing system according to disclosed embodiments.

FIG. 2 depicts a schematic view of a parcel processing system 200 according to disclosed embodiments. Trailers 202*a*, 202*b*, through 202*n* are positioned adjacent to a loading dock and dock doors for unloading. An automated unloading apparatus 204*a* is positioned at the open door of the trailer 202*a*. Where manual unloading is used, parcels may be removed from a trailer at a rate of approximately 1000 parcels per hour. The automated unloading apparatus 204*a* may remove parcels from the trailer at a rate of approximately 4,000 to 5,000 parcels per hour.

A sort induction apparatus 214*a* according to this disclosure receives parcels from the automated unloading apparatus 204*a*. The sort induction apparatus 214*a* includes a conveyor belt or other transport apparatus (not shown in FIG. 2) that carries parcels received from the automated unloading apparatus 204*a* through the following: a single layer apparatus 206, a singulation apparatus 208, a scan apparatus 210, and a printing apparatus 212. The single layer apparatus 206 is configured to move any parcels that are positioned on top of other parcels to be positioned directly on the conveyor belt.

That is, the single layer apparatus 206 is configured to reduce to a single layer parcels removed from the trailer 202*a* by the automated unloading apparatus 204*a*. The singulation apparatus 208 is configured to move any parcels that are positioned beside each other, relative to the motion of the conveyor belt, to be positioned before and after each other along the conveyor belt. The combined effect of the single layer apparatus 206 and the singulation apparatus 208 is that parcels are presented to succeeding apparatuses individually, rather than in groups. In some embodiments, the combined actions of a single layer apparatus and a singulation apparatus may be referred to in the aggregate as singulating parcels.

Parcels next pass through the scan apparatus 210, which is configured to read indicia on or in the parcel that identify the parcel and/or its intended destination. Such indicia may be printed or may be encoded on an electronically read device, such as a radio frequency identification (RFID) tag. In some embodiments, parcels may have been oriented so that all such indicia are presented on a common side of the parcels for example, a top side. In other embodiments, the scan apparatus 210 may be configured to scan all sides of each parcel, to detect such indicia regardless of the orientation of the parcel. The scan apparatus 210 is configured to communicate information obtained from scanning the parcel to a parcel processing control system, such as data processing system 100.

The printing apparatus 212 is configured to print one or more further marks or other indicia on parcels, in response to information in the indicia scanned by the scan apparatus 210. The printing apparatus 212 may receive such information directly from the scan apparatus 210 and/or from the data processing system 100. In some embodiments, all parcels directed to a certain address or group of addresses, or all parcels requiring a certain type of handling, might be marked with blue paint or other obvious indicia for easy recognition at a sorting station. In response, subsequent automated or manual sorting steps may selectively route parcels so marked for sorting or other handling separate from other parcels unloaded from the trailer 202*a*.

Figure 3:
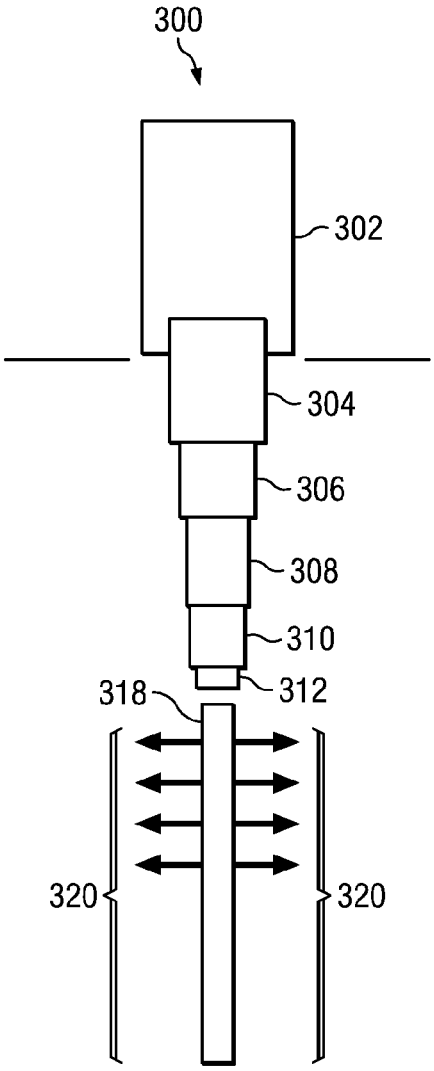
FIG. 3 depicts a schematic view of another parcel processing system according to disclosed embodiments.

After passing through the sort induction apparatus 214*a*, parcels are carried by a transport system 216*a* to a sorting system 218. The sorting system may be a circular system, as shown in FIG. 2, or a linear system, as shown in FIG. 3. The sorting system 218 includes a plurality of automated or manual sorting stations that divert parcels to a corresponding plurality of outputs 220.

An automated unloading apparatus 204*b* is used to unload the trailer 202*b*, and a sort induction apparatus 214*b* is used to singulate, scan, and print parcels before they are carried away by a transport system 216*b*. The transport system 216*b* includes a diversion station 222, at which some parcels may be diverted from being carried to the sorting system 218 and, instead, routed directly to a secondary sorting system 224. Parcels in the sorting system 218 may also be diverted to the secondary sorting system 224 via outputs 228. The secondary sorting system 224 includes a plurality of automated or manual sorting stations that divert parcels to a corresponding plurality of outputs 226.

An automated unloading apparatus 204*n* is used to unload the trailer 202*n*, and a sort induction apparatus 214*n* is used to singulate, scan, and print parcels before they are carried away by a transport system 216*n*. The transport system 216*n* includes a diversion station 230, at which some parcels may be diverted from being carried to the sorting system 218 and, instead, routed to an alternative destination, such as another handling area 232 (not shown in FIG. 2). The other handling area 232 may be referred to as an exception station or 'quick kill' station.

Sorting of parcels in the sorting system 218 and the secondary sorting system 224, as well as diversion of a parcel to a particular output 220 or 226, or by the diversion stations 222 or 230, may be performed under the control of, or based upon information received from, the data processing system 100. Such control and/or information may be based upon information scanned from the parcel by the scan apparatus 210, one or more indicia placed upon the parcel by the printing apparatus 212, or by further scanning or visual inspection of the parcel at one or more sorting stations of the sorting systems 218 or 224.

FIG. 3 depicts a schematic view of another parcel processing system 300 according to disclosed embodiments. A trailer 302 (or other container) contains parcels for delivery or further transportation. An automated unloading apparatus 304 is positioned adjacent to the rearmost parcels in the trailer 302 and activated, to work its way into the trailer 302, unloading parcels from the trailer 302 as it proceeds. Unloaded parcels are carried through a sort induction apparatus 314, which includes a single layer apparatus 306, a singulator apparatus 308, a scan apparatus 310, and a printing apparatus 312. The single layer apparatus 306 is configured to remove any parcels from on top of other parcels. Parcels then pass through the singulator apparatus 308, which is configured to rearrange parcels such that they are presented to succeeding processing stations in single file, with no parcel beside another parcel, relative to the parcels' direction of motion.

The scan apparatus 310 detects identifying indicia on the parcels and the printing apparatus 312 may print one or more additional indicia on the parcels for use in subsequent sorting or processing steps, based upon information in the indicia scanned by the scan apparatus 310. The scan apparatus 310 is configured to communicate information obtained from scanning the parcel to a parcel processing control system, such as data processing system 100. The printing apparatus 312 may receive information directly from the scan apparatus 310 and/or from the data processing system 100.

From the sort induction apparatus 314, unloaded parcels pass directly into a linear sorting system 318, wherein the parcels art diverted manually or by automated mechanisms to a plurality of outputs 320. Where earlier trailer unloading systems may have required simultaneous unloading from a plurality of trailers to provide an adequate flow of parcels to justify the cost of a sorting system, the automated unloading apparatus 304 produces a sufficiently high flow of parcels to supply the sorting system 318 from a single trailer. From the outputs 320, the sorted parcels proceed to further sorting or to delivery or other further transportation. Diversion of a parcel to a particular output 320 may be based upon information scanned from the parcel by the scan apparatus 310, indicia placed upon the parcel by the printing apparatus 312, or by further scanning or visual inspection of the parcel at one or more sorting stations.

Sorting of parcels in the sorting system 318 may be performed under the control of, or based upon information received from, the data processing system 100. Such control may be based upon information scanned from the parcel by the scan apparatus 310, one or more indicia placed upon the parcel by the printing apparatus 312, or by further scanning or visual inspection of the parcel at one or more sorting stations of the sorting system 318.

Figure 4:
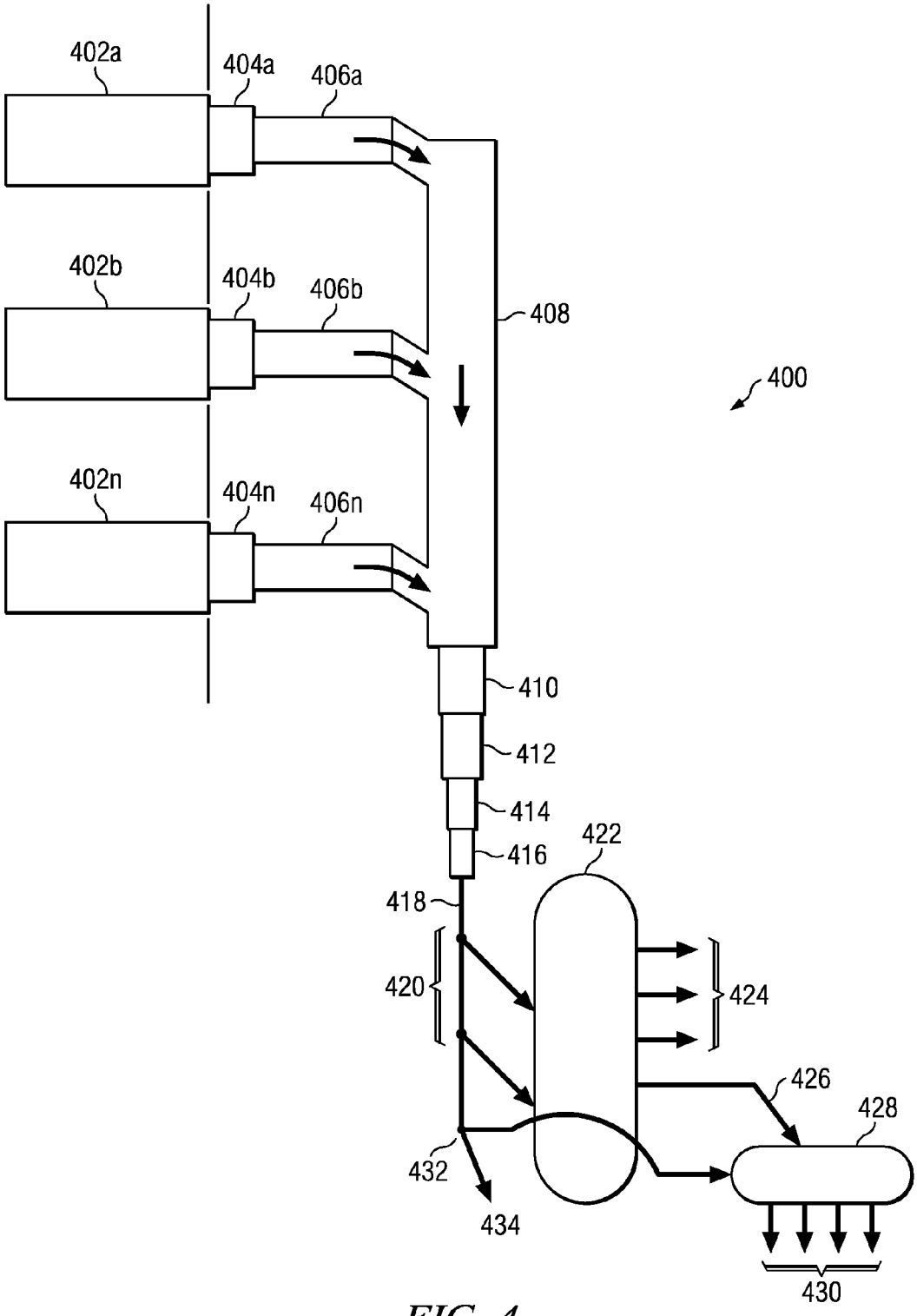
FIG. 4 depicts a schematic view of yet another parcel processing system according to disclosed embodiments.

FIG. 4 depicts a schematic view of yet another parcel processing system 400 according to disclosed embodiments. Trailers 402*a*, 402*b*, through 402*n* are positioned adjacent to a loading dock and dock doors for unloading. Automated unloading apparatuses 404*a*, 404*b*, through 404*n* are positioned at the open doors of the trailers 402*a*, 402*b*, through 402*n*, respectively. Take-away conveyors 406*a*, 406*b*, through 406*n*, respectively, receive parcels unloaded by automated unloading apparatuses 404*a*, 404*b*, through 404*n*, and transport the parcels to a bulk accumulation apparatus 408.

The bulk accumulation apparatus 408 consolidates and transports all parcels unloaded from the trailers 402*a*, 402*b*, through 402*n* to a single layer apparatus 410, which is configured to move any parcels that are positioned on top of other parcels so that all parcels are positioned directly on the conveyor belt. From the single layer apparatus 410, the parcels proceed through a singulation apparatus 412, which is configured to move any parcels that are positioned beside each other, relative to the motion of the parcels, to be positioned before and after each other along the direction of motion. From the singulation apparatus 412, the parcels pass through a scan apparatus 414, wherein they are scanned for indicia that identify the parcel and/or its intended destination. The scan apparatus 414 is configured to communicate information obtained from scanning the parcel to a parcel processing control system, such as data processing system 100. The parcels then pass through a printing apparatus 416, which is configured to print one or more further marks or other indicia on parcels, in response to information in the indicia scanned by the scan apparatus 414. The printing apparatus 416 may receive such information directly from the scan apparatus 414 and/or from the data processing system 100.

From the printing apparatus 416, parcels are transported by a conveyor mechanism 418. Diversion mechanisms 420, responsive to information in the indicia scanned by the scan apparatus 414 or to indicia printed on the parcels by the printing apparatus 416, divert some parcels to a sorting system 422. The sorting system 422 may sort parcels manually, automatically, or using a combination of manual and automatic techniques. Parcels may be routed from the sorting system 422 to outputs 424, for delivery, further sorting, further transportation, or other further processing. Parcels may be routed from the sorting system 422 via a conveyor mechanism 426 to a secondary sorting system 428, for further sorting. Other parcels in the conveyor mechanism 418 may be diverted by a diversion mechanism 432 to the secondary sorting system 428, bypassing the sorting system 422. Parcels not diverted by the diversion mechanisms 420 or 432 may be transported to a further processing system 434.

Sorting of parcels in the sorting system 422 and the secondary sorting system 428, as well as diversion of a parcel to a particular output 424 or 430, or by the diversion stations 420 or 432, may be performed under the control of, or based upon information received from, the data processing system 100. Such control and/or information may be based upon information scanned from the parcel by the scan apparatus 414, indicia placed upon the parcel by the printing apparatus 416, or by further scanning or visual inspection of the parcel at one or more sorting stations of the sorting systems 422 or 428.

Figure 5:
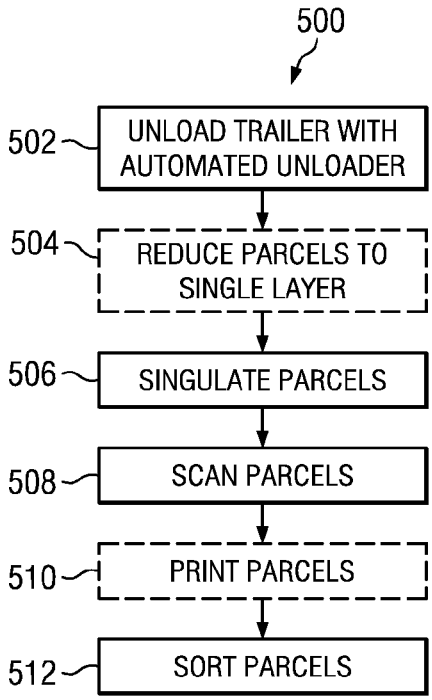
FIG. 5 depicts a flowchart of a process in accordance with disclosed embodiments.

FIG. 5 depicts a flowchart of a process 500 in accordance with disclosed embodiments. In step 502, parcels are unloaded from a trailer or other container using an automated unloading apparatus. In optional step 504, where the parcels are not already configured in a single layer, the parcels are reduced to a single layer. In step 506, the parcels are singulated, wherein any parcels that are positioned beside each other, relative to the motion of the parcels, are repositioned to be before and after each other along the direction of motion. In step 508, the parcels are scanned for indicia that identify the parcels and/or their intended destinations. In optional step 510, some parcels are printed with one or more additional indicia to facilitate parcel handling or routing at subsequent processing steps. In step 512, the parcels are sorted for delivery, further sorting, or further transportation.

Those skilled in the art will recognize that, for simplicity and clarity, the full structure and operation of all systems suitable for use with the present disclosure is not being depicted or described herein. Instead, only so much of the physical systems as is unique to the present disclosure or necessary for an understanding of the present disclosure is depicted and described. The remainder of the construction and operation of the systems disclosed herein may conform to any of the various current implementations and practices known in the art.

It is important to note that while the disclosure includes a description in the context of a fully functional system, those skilled in the art will appreciate that at least portions of the mechanism of the present disclosure are capable of being distributed in the form of a instructions contained within a machine-usable, computer-usable, or computer-readable medium in any of a variety of forms, and that the present disclosure applies equally regardless of the particular type of instruction or signal bearing medium or storage medium utilized to actually carry out the distribution. Examples of machine usable/readable or computer usable/readable mediums include: nonvolatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs). In particular, computer readable mediums can include transitory and non-transitory mediums, unless otherwise limited in the claims appended hereto.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, or function is an essential element which must be included in the claim scope: the scope of patented subject matter is defined only by the allowed claims. Moreover, none of these claims are intended to invoke paragraph six of 35 USC §112 unless the exact words "means for" are followed by a participle.

What is claimed is:

1. A parcel processing system, comprising:

an automated unloading apparatus, configured to unload parcels from a trailer substantially without human intervention;

a single layer apparatus configured to reduce parcels unloaded by the automated unloading apparatus to a single layer;

a singulation apparatus, configured to singulate parcels unloaded by the automated unloading apparatus, wherein the singulation apparatus is configured to singulate parcels reduced to the single layer by the single layer apparatus such that parcels are presented to succeeding apparatuses in single file;

a scan apparatus, configured to read from the parcels identifying information relating to the parcels; and a sorting system, configured to sort the parcels according to the information read from the parcels by the scan apparatus.

2. The parcel processing system of claim 1, wherein:

the automated unloading apparatus comprises a plurality of automated unloading apparatuses, configured to unload parcels from a corresponding plurality of trailers;

the single layer apparatus comprises a plurality of single layer apparatuses corresponding to the plurality of automated unloading apparatuses; each single layer apparatus configured to reduce parcels unloaded by the corresponding automated unloading apparatus to a corresponding single layer;

the singulation apparatus comprises a plurality of singulation apparatuses corresponding to the plurality of automated unloading apparatuses, each singulation apparatus configured to singulate parcels unloaded by the corresponding automated unloading apparatus;

the scan apparatus comprises a plurality of scan apparatuses corresponding to the plurality of singulation apparatuses, each scan apparatus configured to read identifying information from the parcels singulated by the corresponding scan apparatus; and the sort apparatus is configured to sort the parcels scanned by the plurality of scan apparatuses according to the information read from the parcels by the plurality of scan apparatuses.

3. The parcel processing system of claim 2, further comprising a plurality of transport systems corresponding to the plurality of scan apparatuses, wherein each transport system is configured to transport parcels scanned by the corresponding scan apparatus to the sort apparatus.

4. The parcel processing system of claim 3, wherein at least one transport system includes a diversion station, configured to divert one or more parcels to a destination other than the sort apparatus.

5. The parcel processing system of claim 1, further comprising a printing apparatus, configured to print indicia on one or more of the parcels according to the information read from the one or more parcels by the scan apparatus.

6. The parcel processing system of claim 1, wherein:

the automated unloading apparatus comprises a plurality of automated unloading apparatuses, configured to unload parcels from a corresponding plurality of trailers;

the parcel processing system further comprises an accumulation apparatus configured to consolidate the parcels unloaded by the plurality of automated unloading apparatuses; and the singulation apparatus is configured to cingulate parcels consolidated by the accumulation apparatus.

7. A parcel processing system, comprising:

a data processing system;

an automated unloading apparatus, configured to unload parcels from a trailer substantially without human intervention;

a single layer apparatus configured to reduce parcels unloaded by the automated unloading apparatus to a single layer;

a singulation apparatus, configured to singulate parcels unloaded by the automated unloading apparatus, wherein the singulation apparatus is configured to singulate parcels reduced to the single layer by the single layer apparatus such that parcels are presented to succeeding apparatuses in single file;

a scan apparatus, configured to read from the parcels identifying information relating to the parcels and send the information to the data processing system; and a sorting system, configured to sort the parcels according to information received from the data processing system.

8. The parcel processing system of claim 7, wherein:

the automated unloading apparatus comprises a plurality of automated unloading apparatuses, configured to unload parcels from a corresponding plurality of trailers;

the single layer apparatus comprises a plurality of single layer apparatuses corresponding to the plurality of automated unloading apparatuses; each single layer apparatus configured to reduce parcels unloaded by the corresponding mated unloading apparatus to a corresponding single layer;

the singulation apparatus comprises a plurality of singulation apparatuses corresponding to the plurality of automated unloading apparatuses, each singulation apparatus configured to singulate parcels unloaded by the corresponding automated unloading apparatus;

the scan apparatus comprises a plurality of scan apparatuses corresponding to the plurality of singulation apparatuses, each scan apparatus configured to read identifying information from the parcels singulated by the corresponding scan apparatus and send the information to the data processing system; and the sort apparatus is configured to sort the parcels scanned by the plurality of scan apparatuses according to information received from the data processing system.

9. The parcel processing system of claim 8, further comprising a plurality of transport systems corresponding to the plurality of scan apparatuses, wherein each transport system is configured to transport parcels scanned by the corresponding scan apparatus to the sort apparatus.

10. The parcel processing system of claim 9, wherein at least one transport system includes a diversion station, configured to divert one or more parcels to a destination other than the sort apparatus, based upon information received from the data processing system.

11. The parcel processing system of claim 7, further comprising a printing apparatus, configured to print indicia on one or more of the parcels according to information received from the data processing system.

12. The parcel processing system of claim 7, wherein:

the automated unloading apparatus comprises a plurality of automated unloading apparatuses, configured to unload parcels from a corresponding plurality of trailers;

the parcel processing system further comprises an accumulation apparatus configured to consolidate the parcels unloaded by the plurality of automated unloading apparatuses; and the singulation apparatus is configured to singulate parcels consolidated by the accumulation apparatus.

13. A method of processing parcels, the method comprising:

unloading a trailer with an automated unloading apparatus, substantially without human intervention;

reducing parcels unloaded by the automated unloading apparatus to a single layer;

singulating parcels unloaded by the automated unloading apparatus, wherein singulating parcels comprises singulating parcels that have been reduced to the single layer;

scanning the parcels to read identifying information relating to the parcels;

sending the information read from the parcels to a data processing system; and sorting the parcels according to information received from the data processing system.

14. The method of claim 13, wherein:

unloading a trailer comprises unloading a plurality of trailers with a corresponding plurality of automated unloading apparatuses;

reducing parcels comprises reducing parcels unloaded by the automated unloading apparatuses using a corresponding plurality of single layer apparatuses;

singulating parcels comprises singulating parcels unloaded by the automated unloading apparatuses using a corresponding plurality of singulation apparatuses;

scanning the parcels comprises scanning the parcels singulated by the plurality of singulation apparatuses using a corresponding plurality of scanning apparatuses;

sending the information read from the parcels comprises sending the information read by each of the plurality of scanning apparatuses to the data processing system; and sorting the parcels comprises sorting the parcels scanned by the plurality of scanning apparatuses.

15. The method of claim 14, further comprising transporting the parcels from the plurality of scanning apparatuses to a sort apparatus.

16. The method of claim 13, further comprising printing indicia on one or more of the parcels according to information received from the data processing system.

17. The method of claim 13, wherein:

unloading a trailer comprises unloading a plurality of trailers with a corresponding plurality of automated unloading apparatuses;

the method further comprises consolidating the parcels unloaded by the plurality of automated unloading apparatuses; and singulating parcels comprises singulating the consolidated parcels.

* * * * *